US010392787B2

(12) United States Patent
Kamata et al.

(10) Patent No.: US 10,392,787 B2
(45) Date of Patent: Aug. 27, 2019

(54) AUTOMATIC FAUCET AND KITCHEN

(71) Applicant: LIXIL Corporation, Tokyo (JP)

(72) Inventors: Azumi Kamata, Tokyo (JP); Yuki Shirai, Tokyo (JP); Mamoru Hashimoto, Tokyo (JP)

(73) Assignee: LIXIL CORPORATION, Tokyo (JP)

( * ) Notice: Subject to any disclaimer, the term of this patent is extended or adjusted under 35 U.S.C. 154(b) by 0 days.

(21) Appl. No.: 15/470,096

(22) Filed: Mar. 27, 2017

(65) Prior Publication Data

US 2017/0198460 A1 Jul. 13, 2017

Related U.S. Application Data

(63) Continuation of application No. PCT/JP2015/064602, filed on May 21, 2015.

(30) Foreign Application Priority Data

Sep. 29, 2014 (JP) ..... 2014-198786

(51) Int. Cl.
*E03C 1/05* (2006.01)
*E03C 1/00* (2006.01)
*E03C 1/04* (2006.01)

(52) U.S. Cl.
CPC ..... *E03C 1/057* (2013.01); *E03C 1/00* (2013.01); *E03C 2001/0415* (2013.01)

(58) Field of Classification Search
CPC ..... A47K 1/02; A47K 1/04; B67D 1/1247; E03C 1/057; E03C 1/18; E03C 2001/0415; E03C 2001/0417
(Continued)

(56) References Cited

U.S. PATENT DOCUMENTS 9,279,239 B2 * 3/2016 Feng ..... E03C 1/057
2005/0151101 A1 * 7/2005 McDaniel ..... E03C 1/057 251/129.04
(Continued)

FOREIGN PATENT DOCUMENTS

CN 202273280 U 6/2012
JP 5171665 * 7/1993 ..... E03C 1/05
(Continued)

OTHER PUBLICATIONS

International Search Report from International Application No. PCT/JP2015/064602 dated Jul. 28, 2015.

*Primary Examiner* — David P Angwin
*Assistant Examiner* — Nicholas Ros
(74) *Attorney, Agent, or Firm* — Muncy, Geissler, Olds & Lowe, P.C.

(57) ABSTRACT

A detachment sensor detects attachment and detachment of a water discharger to and from a retainer. An object sensor detects presence of an object. A controller causes water discharge triggered by detection of an object by the object sensor while the water discharger is attached to the retainer and suppresses water discharge triggered by detection of an object by the object sensor while the water discharger is detached from the retainer. The controller suppresses water discharge triggered by detection of an object by the object sensor after attachment of the water discharger to the retainer until a non-detection state of an object by the object sensor continues for a predetermined period of time.

5 Claims, 13 Drawing Sheets

(58) Field of Classification Search
USPC ..... 137/602–603, 801; 222/464.5, 74; 251/89, 129.04; 4/623, 676, 678
See application file for complete search history.

(56) References Cited

U.S. PATENT DOCUMENTS

| | | | | |
|---|---|---|---|---|
| 2013/0248617 | A1* | 9/2013 | Sawaski | E03C 1/057 239/73 |
| 2015/0368888 | A1* | 12/2015 | Song | E03C 1/057 137/78.1 |

FOREIGN PATENT DOCUMENTS

| | | | |
|---|---|---|---|
| JP | 2639268 | B2 | 8/1997 |
| JP | 2005-344499 | A | 12/2005 |
| JP | 2007-270538 | A | 10/2007 |
| JP | 4351616 | B2 | 10/2009 |
| JP | 2012-067486 | A | 4/2012 |
| WO | WO2013/134525 | A2 | 9/2013 |

* cited by examiner

AUTOMATIC FAUCET AND KITCHEN

CROSS-REFERENCE TO RELATED APPLICATIONS

This application is based upon and claims the benefit of priority from the prior Japanese Patent Application No. 2014-198786, filed on Sep. 29, 2014 and International Patent Application No. PCT/JP2015/064602, filed on May 21, 2015, the entire content of each of which is incorporated herein by reference.

BACKGROUND OF THE INVENTION

1. Field of the Invention

The present invention relates to automatic faucets and kitchens.

2. Description of the Related Art

Kitchens are sometimes furnished with automatic faucets having an automatic water discharge/cutoff function whereby a user's hand, tableware, etc. is detected by a sensor and water is automatically discharged/cutoff. Meanwhile, some of the faucets installed in kitchens have a hose pullout function that enables a user to take out the water spout from a component that retains it and to move it about freely.

The automatic water discharge/cutoff function is often controlled by a sensor (e.g. infrared sensor) provided in the vicinity of the water spout. Consequently, with automatic faucets having both automatic water discharge/cutoff functionality and hose pullout functionality, when the water spout is attached or detached the automatic water discharge unintended by a user ("erroneous water discharge" hereinafter) sometimes occurs when the sensor detects an extended hose, a hand of the user, or other objects.

Against this backdrop, an automatic faucet that halts the automatic water discharge function if the water spout has been removed, and even after the water spout is reattached, suspends the automatic water discharge function until a given period of time elapses has been proposed (reference is made to Patent Document 1, for example). Also, technology for halting the automatic water discharge function if the water spout has been removed, and if with the water spout having been reattached the sensor has detected an object, suspending the automatic water discharge function until nothing is being detected (reference is made to Patent Document 2, for example).

Patent Document 1 JP 2639268 B2

Patent Document 2 JP 2012-67486 A

With the technology of Patent Document 1, however, enhancing the reliability with which erroneous water discharge is prevented requires that the period during which automatic water discharge is suspended be made substantially long, which as a result would be deleterious to the convenience of handling the automatic faucet. What is more, with faucets in kitchens or the like, there are usages unique to kitchens such as washing dishes while water accumulates in a basin or the like. With the technology of Patent Document 1, if an object is left within the sensor's detection range, erroneous water discharge may occur after the period of suspending automatic water discharge elapses.

With the technology of Patent Document 2, in situations where immediately after a hand is once taken away from the water spout the hand is brought near it, such as when reattaching of the water spout doesn't go well, the spout is put in a dislocated state, and reattachment is retried because the sensor goes into its non-detection state for the moment, erroneous water discharge unfortunately occurs. Furthermore, in cases where the sensor is an optical sensor, when the water spout is attached in a situation where the water surface in a basin or the like is present at a position just at the detection distance, the direction of the light being reflected may vary from one moment to the next due to quivering of the water surface, leading to the sensor going into the detection state immediately after having been in the non-detection state and giving rise to erroneous water discharge.

SUMMARY OF THE INVENTION

The present invention has been devised based on the above issues recognized by the present inventors. An object of the present invention is to implement an automatic faucet that effectively prevents erroneous water discharge.

In order to solve the above issues, an automatic faucet according to an embodiment of the present invention includes:

a water discharger having a water discharge port; a retainer that detachably/reattachably retains the water discharger; a first detector that detects detachment and reattachment of the water discharger from and into the retainer; a second detector that detects presence of an object; and a water supply controller that with the water discharger fitted into the retainer, on object detection by the second detector as a trigger, causes the faucet to discharge water, and with the water discharger taken out from the retainer, on object detection by the second detector as a trigger, checks water discharge from the faucet. Until an object non-detection state of no object being detected by the second detector continues for a predetermined time period from the water discharger being fitted into the retainer, the water supply controller checks water discharge with object detection by the second detector being the trigger.

The water discharger may be coupled to the main body of the faucet installed in a fixed manner via a hose. According to this embodiment, automatic water discharge is restarted triggered by detection of an object on a condition that no object is detected for a predetermined period of time (hereinafter referred to as "automatic water discharge suppressing time") after the water discharger has been attached to the retainer. This allows for preventing erroneous water discharge even when an object such as a hand of user is detected or an object is left within a detection range of the second detector during the automatic water discharge suppressing time after attaching the water discharger. This also allows the automatic water discharge suppressing time to be set to a length that does not deteriorate convenience for a user while the accuracy of preventing erroneous water discharge is maintained.

The water supply controller may measure duration time of the object non-detection state, and reset the duration time if the second detector detects an object before the duration time reaches the predetermined time. According to this embodiment, when an object is detected during the automatic water discharge suppressing time, measurement of duration time of the non-detection state of an object is performed again from a default value. This allows for preventing erroneous water discharge in a further secured manner. Erroneous water discharge can be prevented even when the non-detection state and the detection state of an object are switched in a short time such as when a mirror surface body such as a water surface is present at a position around a detection range of the second detector.

If a predetermined condition is satisfied even before the object non-detection state has continued for the predetermined time, on object detection by the second detector as a trigger, the water supply controller may cause the faucet to discharge water. The predetermined condition may be a condition for detecting a state where it is assumed that performing automatic water discharge is more preferable for a user than suppressing automatic water discharge. The predetermined condition may include at least one of distance condition, time condition, and image condition related to detection of an object. According to this embodiment, when the condition based on convenience for a user is satisfied automatic water discharge is performed as an exception even during the automatic water discharge suppressing time. Therefore, usability of the automatic faucet can be enhanced.

The predetermined condition may include that a distance to an object detected by the second detector coincides with a distance determined in advance. This distance may be a distance from the automatic faucet to a detected object assumed when a user intentionally places a hand or other objects to cause automatic water discharge. According to this embodiment, automatic water discharge is performed when a user places an object in order to cause automatic water discharge even during the automatic water discharge suppressing time. Therefore, convenience for a user can be enhanced.

Another embodiment of the present invention is a kitchen. The kitchen comprises the automatic faucet according to any one of the above embodiments. This embodiment allows for implementing a kitchen having high convenience for a user by the automatic faucet that effectively prevents erroneous water discharge.

The present invention allows for effectively preventing erroneous water discharge of an automatic faucet.

BRIEF DESCRIPTION OF THE DRAWINGS

Embodiments will now be described, byway of example only, with reference to the accompanying drawings which are meant to be exemplary, not limiting, and wherein like elements are numbered alike in several Figures, in which.

DETAILED DESCRIPTION OF THE INVENTION

Figure 1:
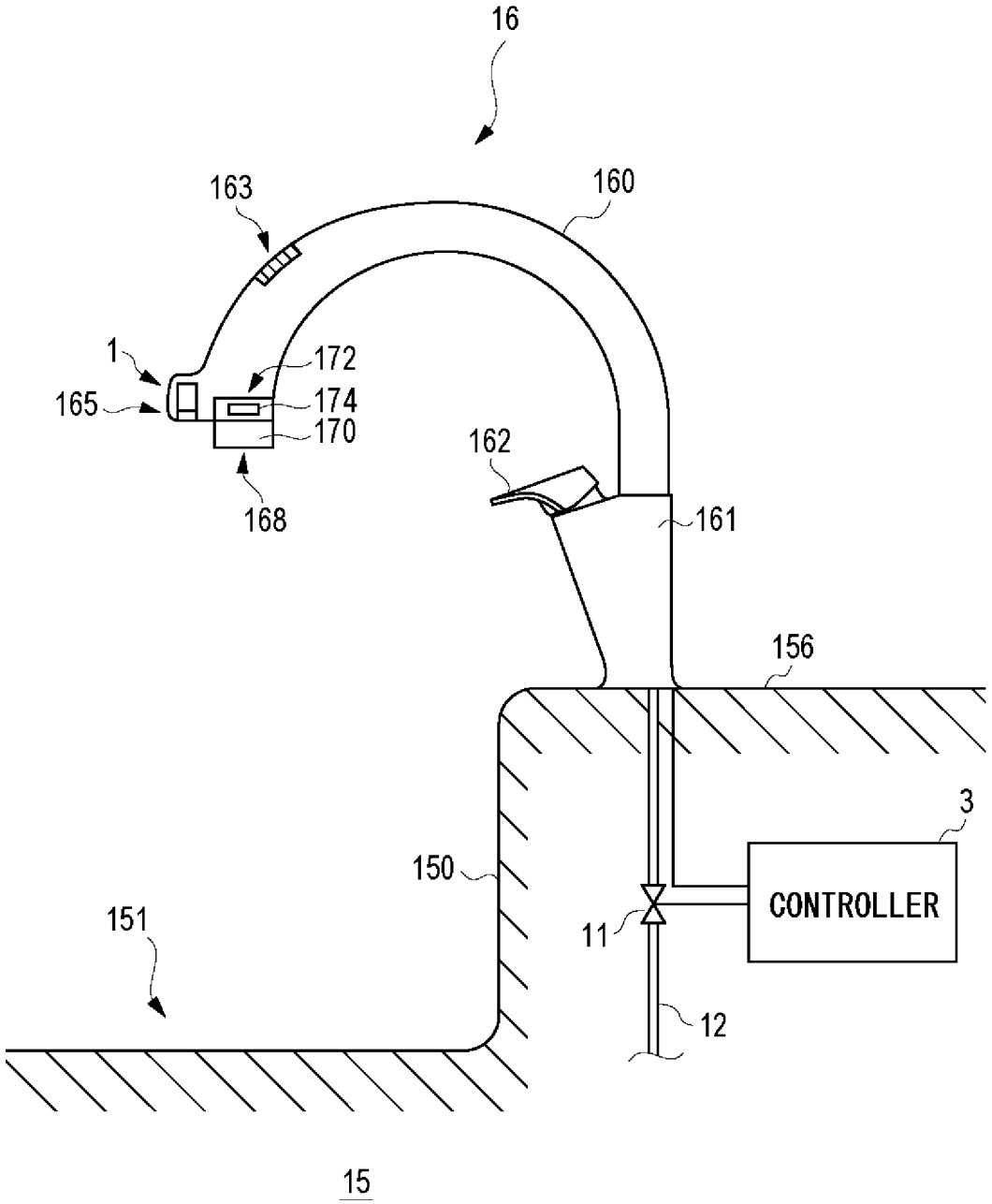
FIG. 1 is a cross-sectional view of a sink including an automatic faucet according to an embodiment.

In the following, an embodiment of the present invention will be described in detail with reference to the drawings. FIG. 1 is a cross-sectional view of a sink 15 including an automatic faucet 16 according to an embodiment. As illustrated in FIG. 1, the sink 15 includes a recessed bowl portion 151 provided to a kitchen counter and an automatic faucet 16 provided with a water discharge port 168. The automatic faucet 16 is included on a counter top 156 that forms an upper surface of the kitchen counter. Although not illustrated, the bowl portion 151 includes a drainage port at the deepest portion thereof. Hereinafter the sink 15 is assumed as a kitchen sink mainly for washing dishes.

The automatic faucet 16 includes abase 161 that forms a pedestal to the counter top 156 and a pipe 160 having substantially an arc shape, one end of which is connected to the base 161 while the other end of which faces the bowl portion 151. The pipe 160 is also called a water discharge pipe. The other end of the pipe 160 includes a water discharger 170 and a filter plate 165 that forms a detection surface of an object sensor 1. The water discharge port 168 is open in the water discharger 170. The filter plate 165 is a filter made of resin that selectively transmits light in the infrared region. The object sensor 1 is disposed in the pipe 160. The object sensor 1 detects presence of an object in a predetermined distance range. A direction of detecting an object is a direction downward, that is, a direction from the object sensor 1 to the bowl portion 151.

The upper surface of the pipe 160 is disposed with a detection surface of a manual operation sensor 163 of a contactless type. The manual operation sensor 163 as a water discharging and stopping operation means is a photoelectric proximity sensor formed by a combination of a light receiving element and a light emitting element such as a phototransistor. The manual operation sensor 163 outputs a manual operation signal representing manual operation by a user when receiving reflection light by a hand or a finger in the proximity thereof within a detection range of approximately several centimeters from the detection surface. A user can alternately switch a continuous water discharge state and a water stopped state by approaching a finger or a hand to the detection surface of the manual operation sensor 163. Note that a handle 162 for opening a plug is provided to the base 161 and a user can stop or discharge water or adjust a flow rate, the temperature, or others by manually operating the handle 162.

Figure 2:
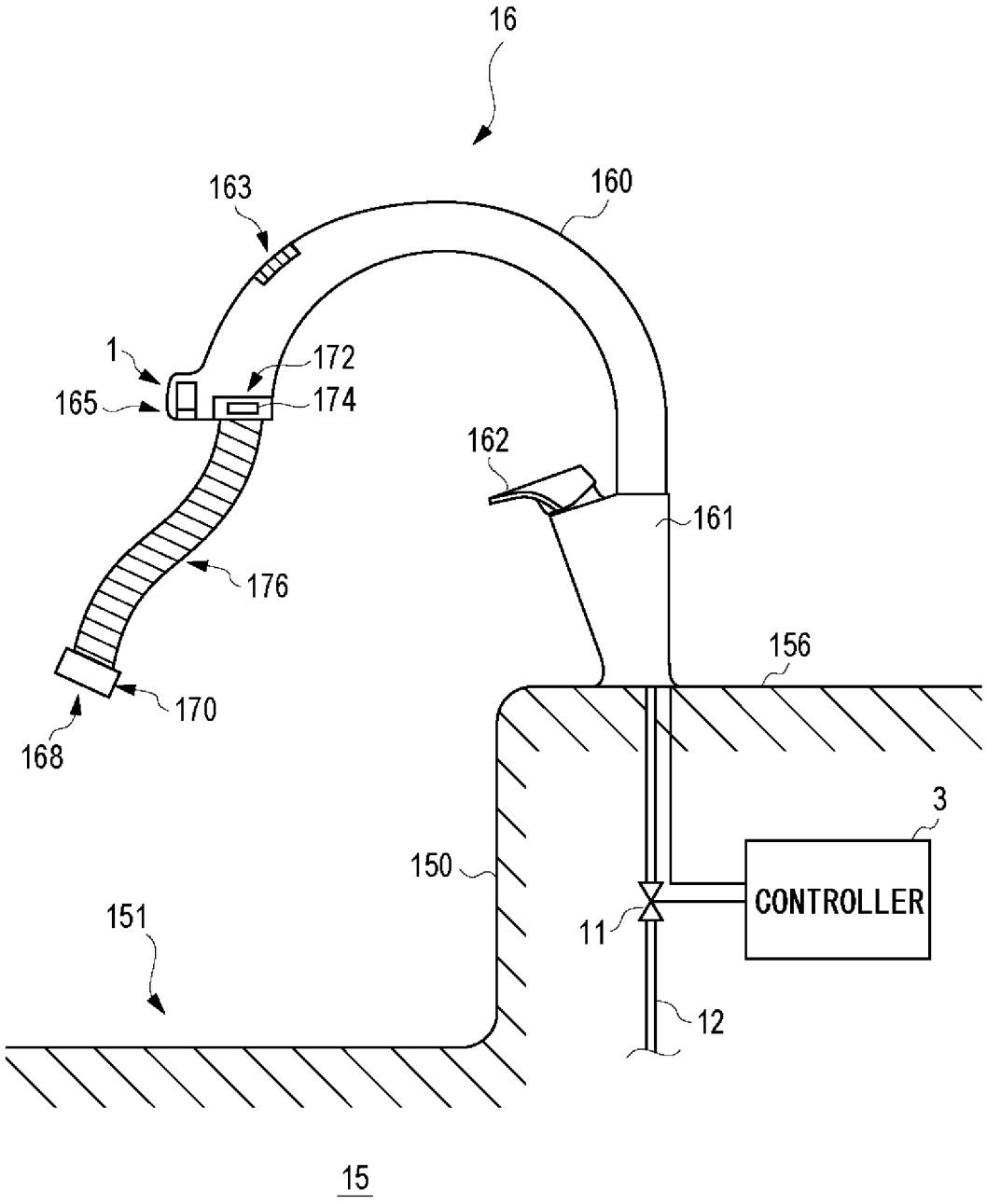
FIG. 2 is a cross-sectional view of the sink including the automatic faucet according to the embodiment.

FIG. 2 is also a cross-sectional view of the sink 15 including the automatic faucet 16 according to the embodiment. As illustrated in the drawing, the water discharger 170 is connected to a hose 176 and the hose 176 is inserted in the pipe 160. When a user grasps and pulls the water discharger 170, the hose 176 is pulled out from the pipe 160. Conversely, when a user attaches the water discharger 170 to a retainer (i.e holder) 172 provided to a tip of the pipe 160, the hose 176 is stored in the pipe 160.

As illustrated in FIGS. 1 and 2, the pipe 160 includes the retainer 172 which is a member to hold the water discharger 170 in a freely detachable and attachable manner and the retainer 172 includes a detachment sensor 174. The detachment sensor 174 detects attachment and detachment of the water discharger 170 to and from the retainer 172. The detachment sensor 174 is a magnetic sensor using a hall element. The detachment sensor 174 outputs an attachment signal representing that the water discharger 170 is attached to the retainer 172 when detecting a magnetic field of a magnet disposed in the water discharger 170.

The sink 15 is incorporated with a controller 3. Water is supplied to the pipe 160 via a water supply pipe 12 a solenoid 11 which is a water valve (electromagnetic valve) provided to the water supply pipe 12. Water supplied to the pipe 160 is discharged from the water discharge port 168 of the water discharger 170 via the hose 176.

Figure 3:
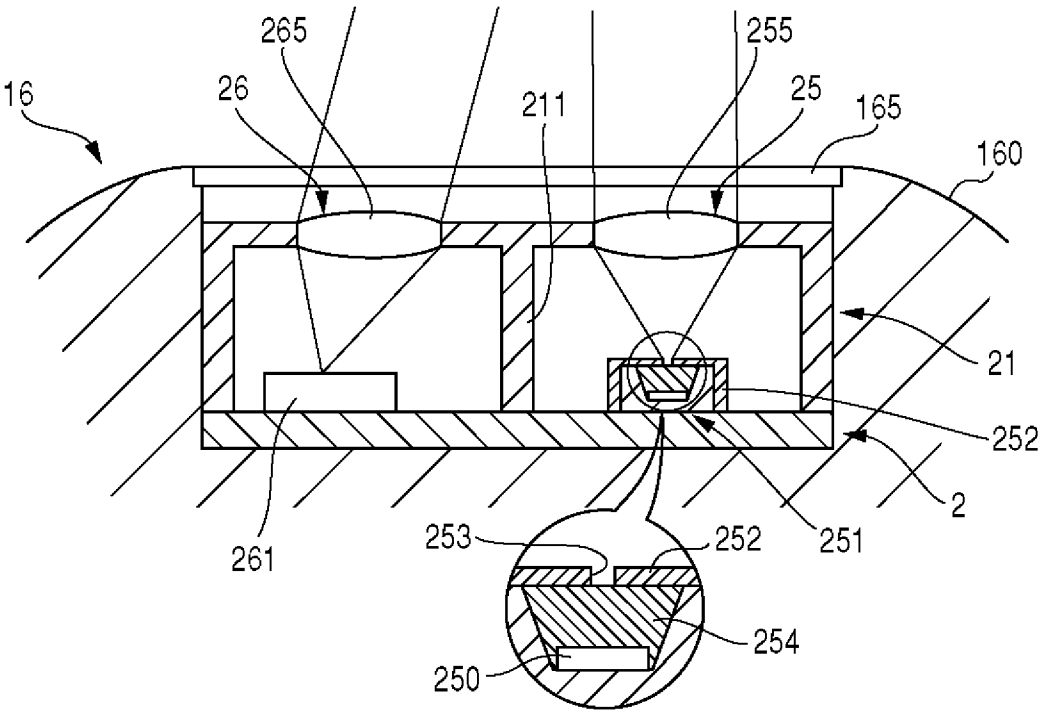
FIG. 3 is a cross-sectional view of an object sensor.

The automatic faucet 16 autonomously controls whether to discharge or to stop water based on a detection result by the object sensor 1. FIG. 3 is a cross-sectional view of the object sensor 1. The object sensor 1 detects presence of an object to which water is discharged. The object sensor 1 includes a sensor unit 2 and a filter plate 165 as illustrated in FIG. 3. Operations of the object sensor 1 is controlled by the controller 3 incorporated in the sink 15. Communication and cooperation among the object sensor 1, the controller 3, and the solenoid 11 allows for automatically stopping or discharging water.

As illustrated in FIG. 3, the sensor unit 2 accommodates a light emitting diode (LED) element 251 and a line sensor 261 in a housing 21. The sensor unit 2 receives power supply from the controller 3 and thereby operates. The sensor unit 2 is attached with a light emitter 25 and an imager 26. The light emitter 25 irradiates infrared light through the filter plate 165 and the imager 26 images reflection light thereof. The light emitter 25 that emits infrared light includes the LED element 251 and a projection lens 255. The imager 26 includes the line sensor 261 and a condensing lens 265. The light emitter 25 and the imager 26 are disposed while interposing a partition wall 211 having a light blocking effect and shifted in the horizontal direction by a predetermined offset amount. The line sensor 261 can be implemented by a known solid-state imaging element such as a charge-coupled device (CCD) or a complementary metal-oxide semiconductor (CMOS).

The LED element 251 is alight emitting element where an LED chip 250 mounted on a cavity on a package substrate is sealed by transparent resin 254 and irradiates infrared light. In the light emitter 25, the LED element 251 is covered by a light-blocking element case 252 provided with a slit hole 253 in a longitudinal direction. This allows the light emitter 25 to project sharp light a spread angle of which is suppressed toward a distance measurement target.

Figure 4:
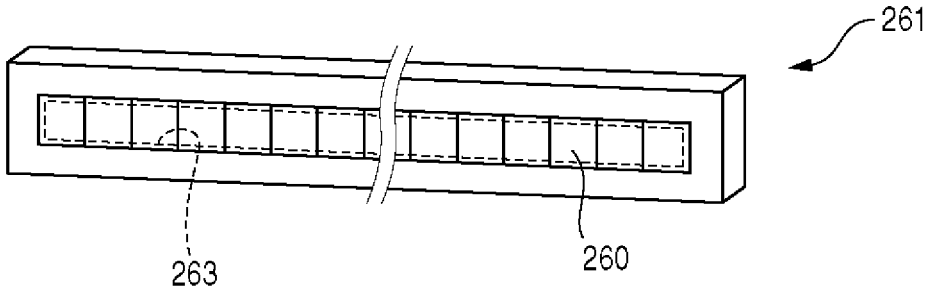
FIG. 4 is a perspective view illustrating a line sensor.

FIG. 4 is a perspective view illustrating the line sensor 261. The line sensor 261 is a one-dimensional imaging sensor where pixels 260 that convert the amount of light received into an electrical physical quantity are linearly arrayed. The line sensor 261 includes 64 pixels 260 as effective pixels. The line sensor 261 is formed with a light receiving area 263 by these 64 pixels 260. The line sensor 261 is attached to face a bowl surface 150 of the bowl portion 151 (in other words, a bottom surface of the sink 15). When there is no blocking object such as a hand in an angle of view of the line sensor 261, the bowl surface 150 of the bowl portion 151 is included in an imaging range thereof.

The line sensor 261 outputs imaging data every time light-receiving operation is executed. The imaging data output by the line sensor 261 is one-dimensional digital data where pixels value of 256 tones representing the degree of amount of light received are arrayed in the order of the respective pixels 260. The line sensor 261 includes an electronic shutter (not illustrated). The line sensor 261 is capable of avoiding saturation of the amount of light received by the respective pixels 260 in the imaging data by adjusting exposure time using the electronic shutter.

Figure 5:
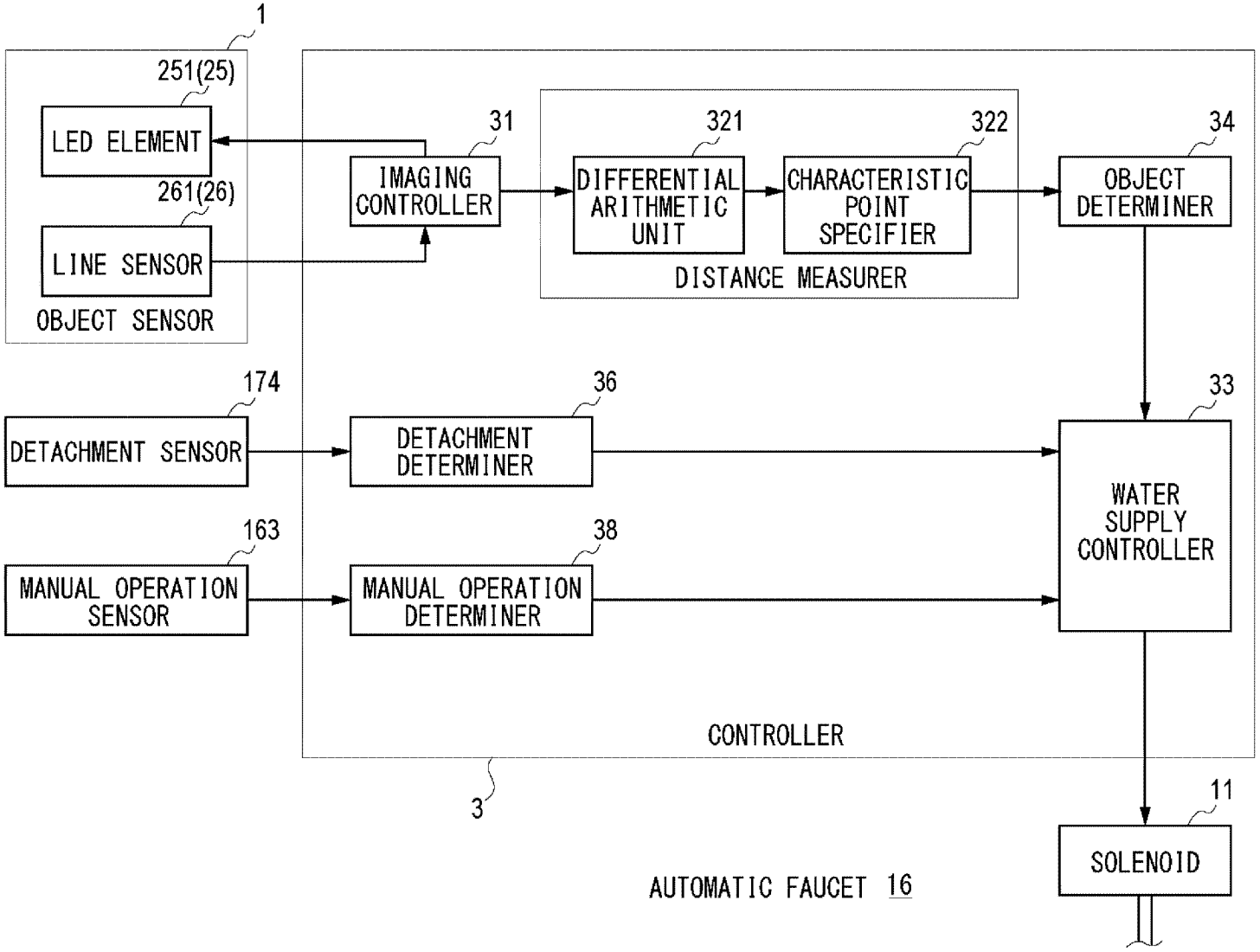
FIG. 5 is a block diagram schematically illustrating a functional configuration of a controller.

FIG. 5 is a block diagram schematically illustrating a functional configuration of the controller 3. The controller 3 receives power supply from a commercial power source and thereby operates and controls the solenoid 11 based on contents notified by the respective sensors. In order to implement this control, the controller 3 includes an imaging controller 31, a distance measurer 32, a water supply controller 33, an object determiner 34, detachment determiner 36, and a manual operation determiner 38.

Each of the blocks illustrated herein in the block diagram can be implemented by an element or a mechanical device including a CPU or a memory of a computer from the perspectives of hardware and, from the perspectives of software, by a computer program or the like. Here, functional blocks implemented by coordination thereof are illustrated. Therefore, it should be understood by a person skilled in the art that these functional blocks can be implemented by various forms by hardware, software, or a combination thereof.

The imaging controller 31 controls the line sensor 261 in the imager 26 and the LED element 251 in the light emitter 25. Specifically, the imaging controller 31 controls the line sensor 261 such that intermittent operation where an operational period and a nonoperational period are alternately switched is performed and causes the LED element 251 to emit light in the operational period. For example, the imaging controller 31 may control the line sensor 261 by setting the operational period and the nonoperational period every 0.3 to 0.5 seconds. The imaging controller 31 sets the nonoperational period by halting power supply to the line sensor 261 from termination of a previous operational period until interval time elapses and sets the operational period by restarting power supply when the interval time has elapsed.

The imaging controller 31 controls the line sensor 261 such that light-receiving operation is executed twice in one operational period. First light-receiving operation is executed without light emission by the LED element 251. Second light-receiving operation is executed with light emission by the LED element 251. The imaging controller 31 controls the line sensor 261 such that imaging data is output for every light-receiving operation.

The distance measurer 32 measures a distance from the line sensor 261 to a distance measurement target based on the imaging data imaged by the line sensor 261. To implement measurement of the distance, the distance measurer 32 includes a differential arithmetic unit 321 and a characteristic point specifier 322. The differential arithmetic unit 321 and the characteristic point specifier 322 in the distance measurer 32 will be described below.

Figure 6:
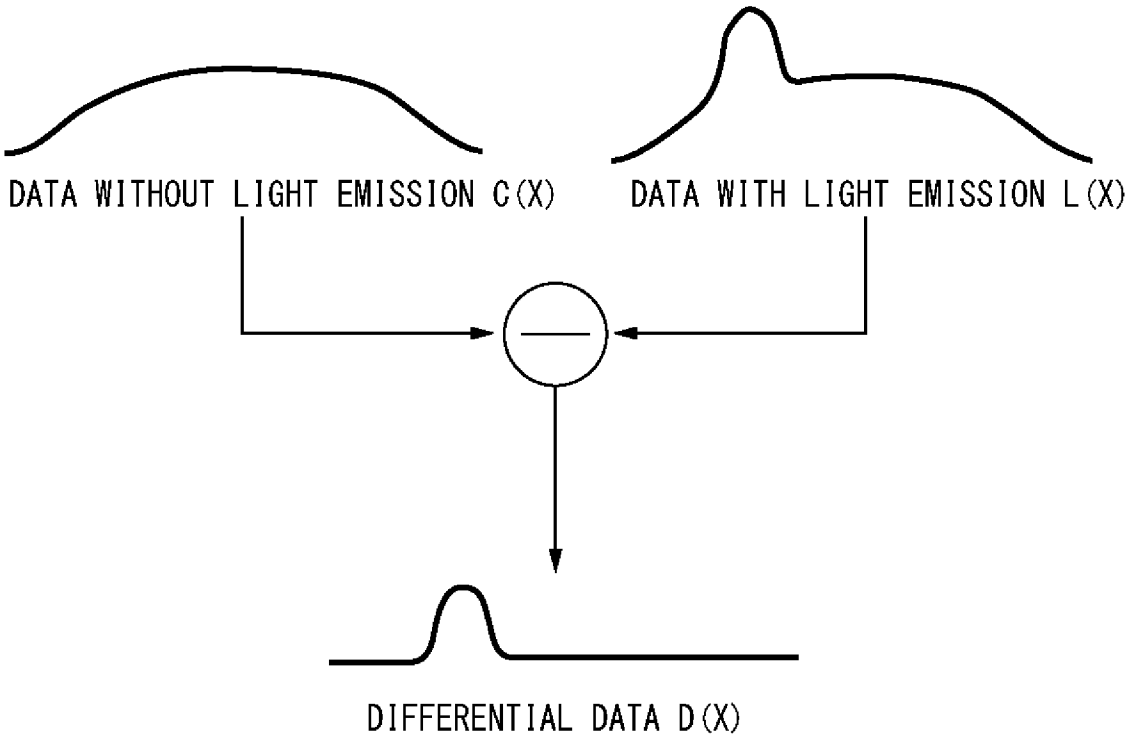
FIG. 6 is a diagram illustrating a procedure of generating differential data executed by a differential arithmetic unit.

FIG. 6 is a diagram illustrating a procedure of generating differential data executed by the differential arithmetic unit 321. The differential arithmetic unit 321 fetches data without light emission C(x) which is imaging data of the first light-receiving operation without light emission by the LED element 251 and data with light emission L(x) of the second light-receiving operation under LED light (projection light by the LED element 251). The differential arithmetic unit 321 stores the fetched data in a work memory (not illustrated).

The differential arithmetic unit 321 subtracts the data without light emission C(x) from the data with light emission L(x) stored in the work memory and derives differential data D(x) therebetween. A letter x represents a pixel number from 0 to 63 and L(n) represents a pixel value of a pixel having a pixel number n. The differential data D(x) where the data without light emission C(x) only with surrounding light is subtracted from the data with light emission L(x) with the surrounding light as well as the LED light is suppressed with influence by the surrounding light and thus is a component of reflection light corresponding to the LED light.

The characteristic point specifier 322 calculates a position of a characteristic point based on the differential data D(x) derived by the differential arithmetic unit 321. Here the "position of a characteristic point of the differential data D(x)" refers to a position on the differential data D(x) used for measurement of the distance measurement target. More specifically, a position of the characteristic point of the differential data D(x) is represented by a position on the line sensor 261 corresponding to a position on the differential data D(x). The position on the line sensor 261 can be represented by a pixel number in the line sensor 261, for example. Note that a pixel number in the line sensor 261 may not be an integer value but a real value representing a subpixel.

The characteristic point of the differential data D(x) calculated by the characteristic point specifier 322 may be any point as long as the point can be used for measurement of a distance to a distance measurement target. Examples include a point corresponding to a mode, a median, or the center of gravity when the differential data D(x) is assumed as a frequency distribution. The characteristic point specifier 322 according to the embodiment assumes, as the characteristic point, the center of gravity calculated by a simple calculation method in order to mitigate a calculation load. This calculation method will be described below with reference to FIG. 7 where the pixel number x is defined for a horizontal axis and the pixel value (amount of light received) D(x) is defined for a vertical axis.

Figure 7:
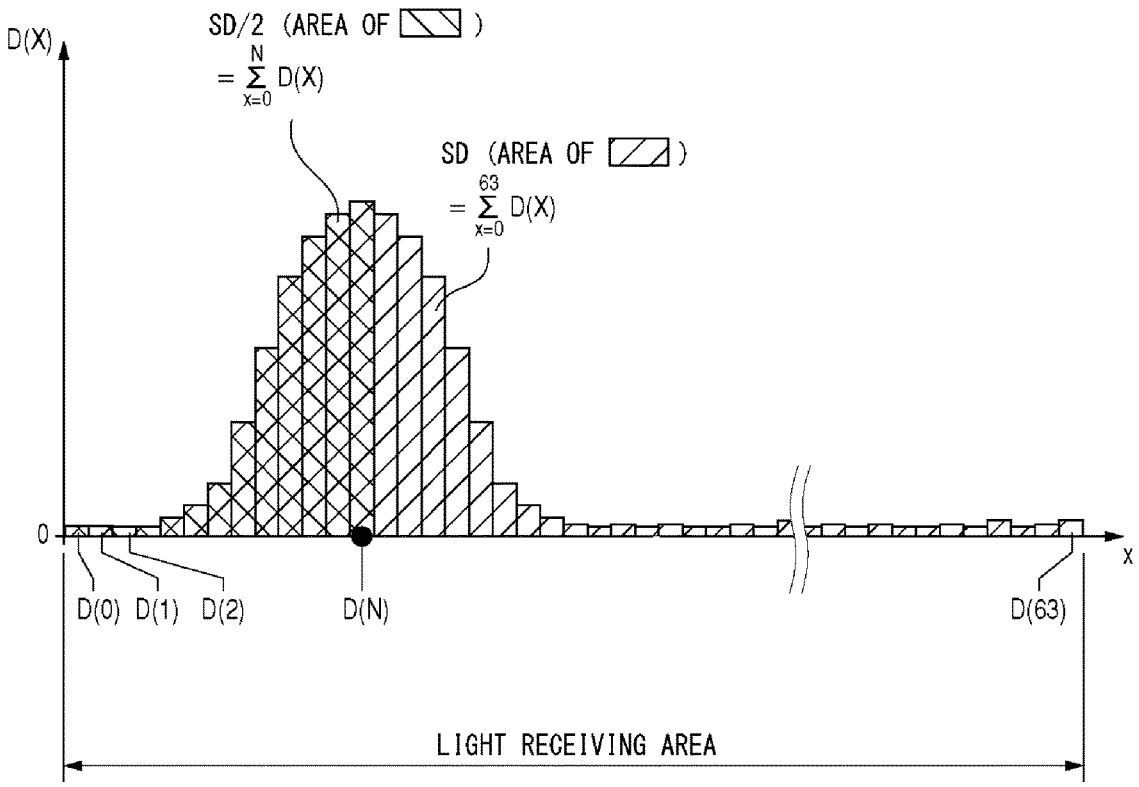
FIG. 7 is a diagram illustrating an exemplary procedure of calculating a characteristic point of differential data executed by a characteristic point specifier.

FIG. 7 is a diagram illustrating an exemplary procedure of calculating a characteristic point of differential data D(x) executed by the characteristic point specifier 322. The drawing is a graph where the horizontal axis represents x, that is a pixel number in the line sensor 261 and the vertical axis represents a value of the differential data D(x) that is a function of x, which is the amount of reflection light.

The characteristic point specifier 322 first integrates the differential data D(x) and derives a total sum SD of pixel values of the 64 pixels in the line sensor 261. In FIG. 7, the total sum SD corresponds to an area of a region hatched bylines inclined upward to the right. The characteristic point specifier 322 integrates pixel values of pixels 260 in order from the leftmost pixel having a pixel number of zero in the light receiving area 263 and assumes, as the center of gravity of the differential data D(x), a position of a pixel (illustrated by a black dot) having a pixel number of N when the integrated value reaches SD/2. In FIG. 7, the integrated value SD/2 corresponds to an area of a region hatched by lines inclined downward to the right. This region is included in the region of the total sum SD and is recognized as a crosshatched region in FIG. 7.

The differential data D(x) of reflection light of a distance measurement target such as a hand of a user and tableware such as a cup generally forms a distribution of a mountain-like shape as illustrated in FIG. 7. Here, the characteristic point (e.g. position of the center of gravity) of the differential data D(x) varies depending on a distance from the imager 26 to the distance measurement target.

Figure 8:
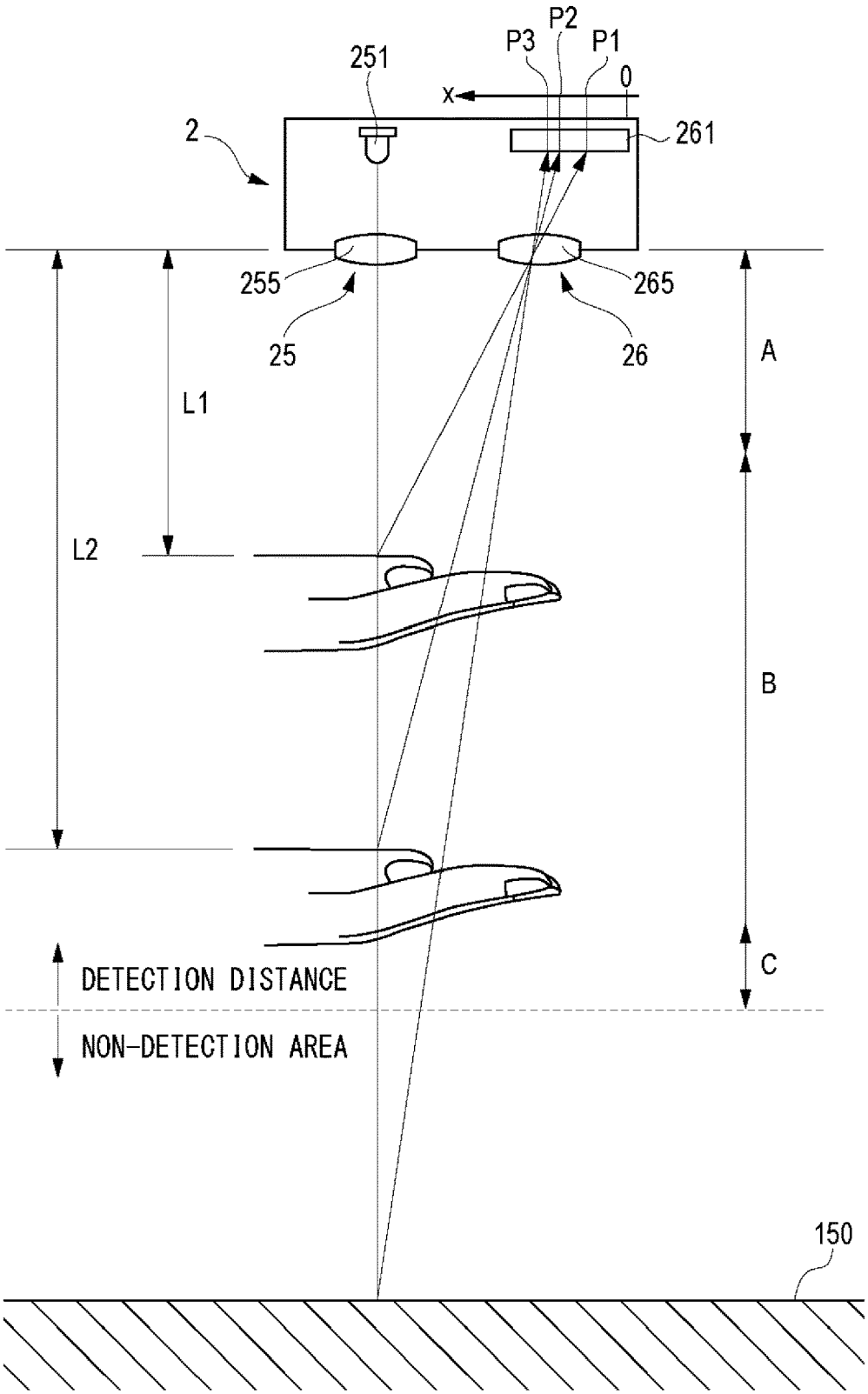
FIG. 8 is a diagram illustrating relation between the distance between a distance measurement target and an imager and a position of the characteristic point of the differential data.

FIG. 8 is a diagram illustrating relation between a distance between a distance measurement target and the imager 26 and a position of the characteristic point of the differential data D(x). FIG. 8 schematically illustrates positional relation among the sensor unit 2 and the bowl surface 150 of the bowl portion 151 in the sink 15 illustrated in FIG. 1 and a hand of a user. As illustrated in FIG. 8, an incident position varies depending on a distance between the imager 26 and a distance measurement target when reflection light, by a hand that is the distance measurement target, out of LED light irradiated by the LED element 251 enters the line sensor 261.

As the distance between the imager 26 and the distance measurement target becomes shorter, an incident position on the line sensor 261 is position rightward in FIG. 8 while positioned leftward as the distance becomes longer. Specifically, when a distance between the imager 26 and the distance measurement target is L1, reflection light enters a point P1 on the line sensor 261. When the distance between the imager 26 and the distance measurement target is L2 which is longer than L1, reflection light enters a point P2 on the line sensor 261. In FIG. 8, the point P2 is on a left side of the point P1. Note that the x axis extending from left to right in FIG. 7 extends from right to left in FIG. 8. Therefore, as the distance between the imager 26 and the distance measurement target is shorter, an x coordinate of the characteristic point of the differential data D(x) of the reflection light becomes smaller. That is, the distance between the imager 26 and the distance measurement target and a value of an x coordinate in the line sensor 261 of the center of gravity that is the characteristic point corresponds one to one.

Correspondence relation between a value of an x coordinate in the line sensor 261 and a distance to the distance measurement target may be stored in advance in a storage device such as a memory. Therefore, the characteristic point specifier 322 is capable of deriving the distance between the imager 26 and the measurement target by deriving an x coordinate of the characteristic point of the differential data D(x) of reflection light of the distance measurement target.

Note that the distance measurer 32 may measure the distance to the distance measurement target by using the principle of triangulation based on an incident position of the reflection light corresponding to light emission by the light emitter 25. For example, correspondence relation between a value of an x coordinate in the line sensor 261 and an incidence angle of reflection light on the line sensor 261 may be stored in advance in a storage device. Therefore, the characteristic point specifier 322 may derive an x coordinate of the characteristic point of the differential data D(x) of reflection light of the distance measurement target and thereby specify an incidence angle associated with the x coordinate. Then the distance between the light emitter 25 and the distance measurement target may be derived based on the incidence angle and a predetermined distance from the light emitter 25 to the imager 26.

Referring back to FIG. 5, the object determiner 34 determines presence of an object (hereinafter referred to as "detection target") within a predetermined range of distance from the object sensor 1. Specifically, the object determiner 34 holds a detection threshold predetermined for specifying whether to regard a distance measurement target as a detection target. The detection threshold represents the distance from the object sensor 1. The detection threshold may be set with appropriate time by knowledge or experience of a developer of the automatic faucet 16 or an experiment using the automatic faucet 16. For example the detection threshold may be set at an upper limit distance where presence of a detection target can be detected, in other words the distance to the detection target can be measured, upon designing of the object sensor 1.

The object determiner 34 detects the distance measurement target as a detection target when the distance L measured by the characteristic point specifier 322 of the distance measurer 32 is smaller than the detection threshold. On the contrary, when the distance L measured by the characteristic point specifier 322 is more than or equal to the detection threshold, the detection target is not detected. That is, the object determiner 34 determines that there is no object to which water is discharged. The object determiner 34 outputs information representing presence of the detection target (hereinafter referred to as "target presence information") to the water supply controller 33.

The detachment determiner 36 detects attachment and detachment of the water discharger 170 to and from the retainer 172 of the pipe 160. Specifically, the detachment determiner 36 determines that the water discharger 170 is attached to the retainer 172 when receiving an attachment signal from the detachment sensor 174. The detachment determiner 36 determines that the water discharger 170 is detached from the retainer 172 when not receiving an attachment signal from the detachment sensor 174. The detachment determiner 36 outputs information representing attachment and detachment (hereinafter referred to as "detachment information") of the water discharger 170 to the water supply controller 33. The detachment determiner 36 detects that the water discharger 170 has transited from a detached state to an attached state and outputs detachment information representing the transition to the water supply controller 33 when transiting from a state not receiving an attachment signal from the detachment sensor 174 to a state receiving the attachment signal.

The manual operation determiner 38 detects user operation of the manual operation sensor 163, typically manual water discharge operation and manual water stopping operation by a user. Specifically, the manual operation determiner 38 determines that operation of the manual operation sensor 163 by a user, for example operation of placing a hand or a finger, is performed when receiving a manual operation signal from the manual operation sensor 163. The manual operation determiner 38 then outputs information representing that the user operation is received (hereinafter referred to as "manual operation information") to the water supply controller 33.

Note that instead of the configuration illustrated in FIG. 5, the object sensor 1 may be configured as a sensor unit including the imaging controller 31, the distance measurer 32, and the object determiner 34. Also, the detachment sensor 174 may be configured as a sensor unit including the detachment determiner 36. Moreover, the manual operation sensor 163 may be configured as a sensor unit including the manual operation determiner 38.

The water supply controller 33 controls to open the solenoid 11 to discharge water from the water discharge port 168 according to detection contents of the respective sensors, in other words, determination results from the object determiner 34, the detachment determiner 36, and the manual operation determiner 38. Alternatively, the water supply controller 33 controls to close the solenoid 11 and stops water discharge from the water discharge port 168, that is, stops water from the automatic faucet 16.

First, manual water discharge processing based on user operation will be described. The water supply controller 33 initiates water discharge triggered by detection of user operation via the manual operation sensor 163 while water is stopped. The water supply controller 33 also halts water discharge triggered by detection of user operation via the manual operation sensor 163 while water is discharged.

Next, automatic water discharge processing will be described. When the detachment sensor 174 detects that the water discharger 170 is attached to the retainer 172, the water supply controller 33 initiates water discharge triggered by detection of an object by the object sensor 1. When a non-detection state of an object by the object sensor 1 continues for a predetermined period of time or more (e.g. 1 to 2 seconds) during automatic water discharge, the water supply controller 33 halts water discharge.

When the detachment sensor 174 detects that the water discharger 170 is detached from the retainer 172, the water supply controller 33 suppresses water discharge even when the object sensor 1 detects an object. This is to prevent erroneous water discharge to a hand of a user when the user detaches the water discharger 170 from the retainer 172. An operation state where automatic water discharge is suppressed in order to prevent erroneous water discharge in the above manner is hereinafter referred to as an "erroneous water discharge prevention mode."

Triggered by detection by the detachment sensor 174 that the water discharger 170 has transited from a state of detached from the retainer 172 to a state of attached thereto, the water supply controller 33 initiates measurement of a duration period of a non-detection state of an object by the object sensor 1. The water supply controller 33 maintains the erroneous water discharge prevention mode until the non-detection state of an object by the object sensor 1 continues for a predetermined automatic water discharge suppressing time. That is, the water supply controller 33 suppresses water discharge triggered by detection of an object by the object sensor 1. In the embodiment, continuation of the non-detection state of an object for the automatic water discharge suppressing time without interruption is regarded as condition for terminating the erroneous water discharge prevention mode. The automatic water discharge suppressing time may be set at appropriate time by knowledge or experience of a developer of the automatic faucet 16 or an experiment using the automatic faucet 16, such as 3 to 5 seconds.

The water supply controller 33 resets duration time of the non-detection state and maintains the erroneous water discharge prevention mode when the object sensor 1 detects an object before the non-detection state of an object by the object sensor 1 continues for the automatic water discharge suppressing time after the water discharger 170 is attached. The water supply controller 33 maintains the erroneous water discharge prevention mode during a period from transition to the non-detection state by the object sensor 1 until the non-detection state continues for the automatic water discharge suppressing time.

Operations of the automatic faucet 16 with the above configuration will be described.

Figure 9:
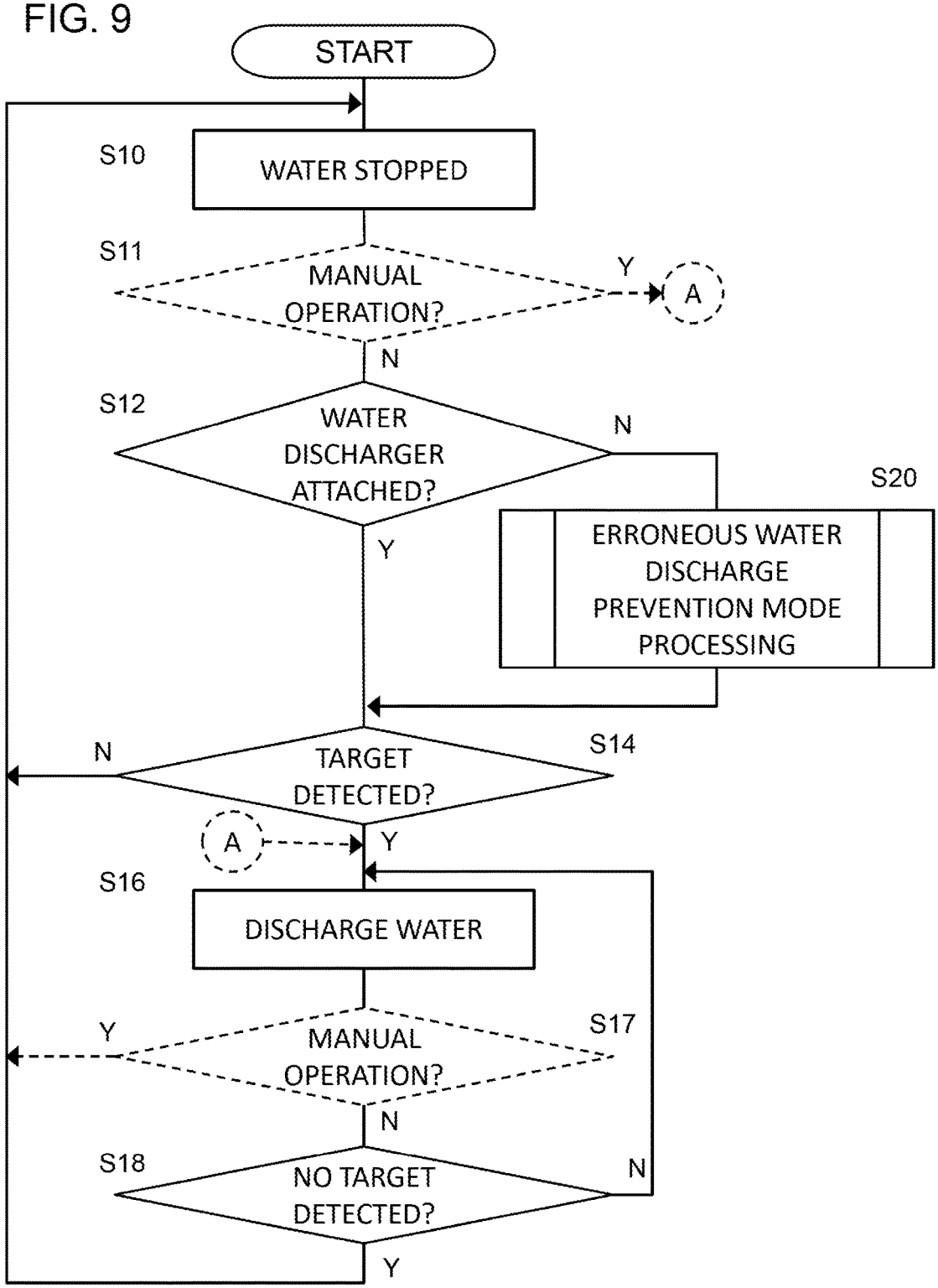
FIG. 9 is a flowchart illustrating automatic water discharge processing executed by the automatic faucet.

FIG. 9 is a flowchart illustrating the automatic water discharge processing executed by the automatic faucet 16. The processing in the present flowchart is initiated when power source is input to the controller 3. Immediately after the initiation, water supply is halted, that is, water is stopped (S10).

When receiving, from the detachment determiner 36, detachment information representing that the water discharger 170 is attached to the retainer 172 while water is stopped (Y in S12), triggered by reception of target presence information representing detection of an object from the object determiner 34 (Y in S14), the water supply controller 33 initiates water discharge (S16). When receiving, from the detachment determiner 36, detachment information representing that the water discharger 170 is attached to the retainer 172 while water is stopped (Y in S12) and receiving target presence information representing that no object is detected (N in S14), the water supply controller 33 returns to S10 and keeps halting water discharge.

While continuously receiving target presence information representing detection of an object (N in S18), the water supply controller 33 returns to S16 and keeps discharging water. When receiving target presence information representing that no object is detected (Y in S18), the water supply controller 33 returns to S10 and terminates water discharge. When receiving, from the detachment determiner 36, detachment information representing that the water discharger 170 is detached from the retainer 172 while water is stopped (N in S12), the water supply controller 33 transits to the erroneous water discharge prevention mode (S20). Note that also when the water discharger 170 is detached during water discharge, the water supply controller 33 may of course transit to the erroneous water discharge prevention mode.

Figure 10:
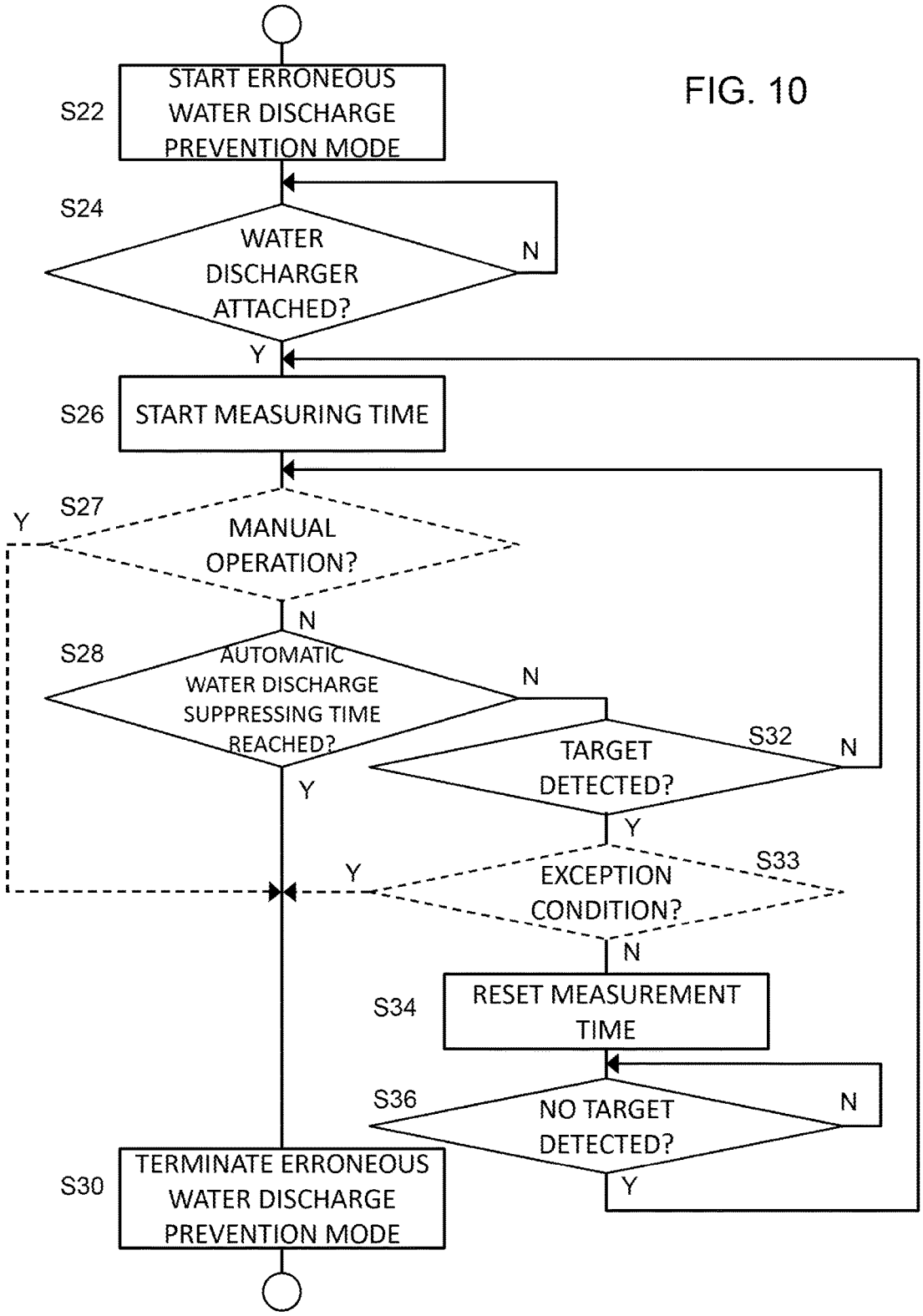
FIG. 10 is a flowchart illustrating details of an erroneous water discharge prevention mode processing of S20 in FIG. 9.

FIG. 10 is a flowchart illustrating details of the erroneous water discharge prevention mode processing of S20 in FIG. 9. The water supply controller 33 initiates the erroneous water discharge prevention mode (S22). As described above, water discharge triggered by detection of an object by the object sensor 1 is suppressed in the erroneous water discharge prevention mode. While receiving detachment information representing that the water discharger 170 is detached from the retainer 172 (N in S24), the water supply controller 33 remains in the erroneous water discharge prevention mode. When transiting from a state of receiving detachment information representing that the water discharger 170 is detached from the retainer 172 to a state of receiving detachment information representing that the water discharger 170 is attached to the retainer 172 (Y in S24), the water supply controller 33 initiates measurement of duration time of the non-detection state of an object (hereinafter referred to as "non-detection duration time") by the object sensor 1 (S26). For example, a counter value retained by a predetermined timer circuit may be increased as time elapses.

Before the non-detection duration time reaches predetermined automatic water discharge suppressing time (N in S28) target presence information representing detection of an object is not received (N in S32), the flow returns to the determination in S28. When the non-detection duration time reaches predetermined automatic water discharge suppressing time (Y in S28), that is, the state where target presence information representing detection of an object is not received is maintained for the automatic water discharge suppressing time, the water supply controller 33 cancels the erroneous water discharge prevention mode (S30). Then automatic water discharge triggered by detection of an object by the object sensor 1 is restarted. Before the non-detection duration time reaches the automatic water discharge suppressing time (N in S28) target presence information representing detection of an object is received (Y in S32), the water supply controller 33 resets the non-detection duration time having been measured (S34).

Thereafter the water supply controller 33 waits until reception of target presence information representing that no object is detected or until target presence information representing detection of an object is not received (N in S36). When the water supply controller 33 detects transition to a state where no object is detected (Y in S36), the flow returns to S26 and measurement of non-detection duration time is performed again from the start. As a variation, measurement of non-detection duration time may be halted at Y in S32 and the non-detection duration time may be reset at Y in S36. The flow may then return to S26.

As illustrated in the flowcharts in FIGS. 9 and 10, the automatic faucet 16 initiates water discharge triggered by reception, from the manual operation determiner 38, of manual operation information representing acceptance of user operation while water is stopped (S11 in FIG. 9). The automatic faucet 16 further halts water discharge triggered by reception, from the manual operation determiner 38, of manual operation information representing acceptance of user operation while water is discharged (S17 in FIG. 9). The automatic faucet 16 preferentially executes stopping or discharging of water based on manual operation by a user regardless of the erroneous water discharge prevention mode. For example, even when the water discharger 170 is detached from the retainer 172 while water is stopped and the erroneous water discharge prevention mode is active, water is discharged when manual operation information is received from the manual operation sensor 163 (S27 in FIG. 10).

Exemplary operations of a conventional automatic faucet and the automatic faucet 16 of the embodiment will be described in comparison.

Figure 11:
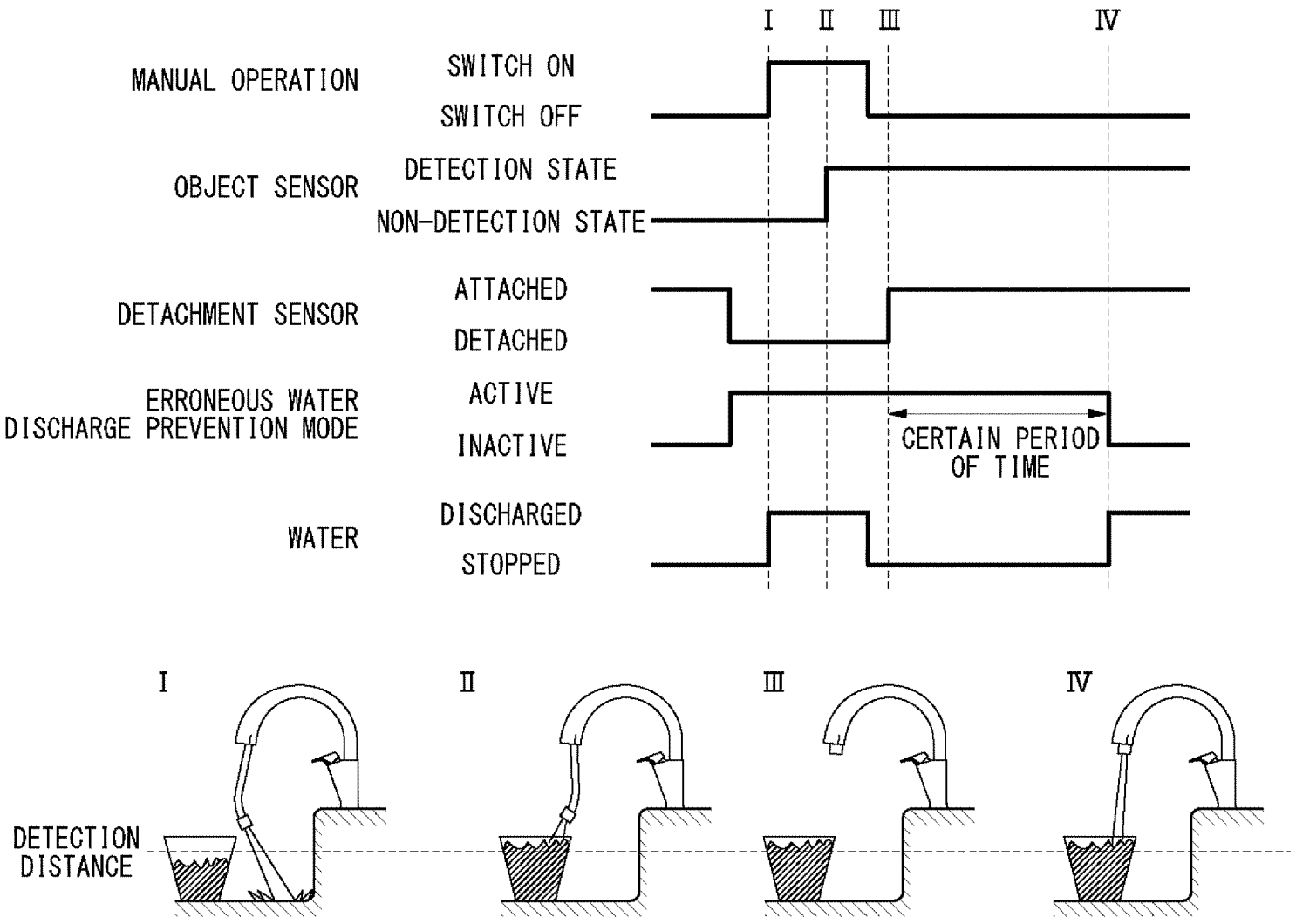
FIG. 11 is a diagram illustrating exemplary operations of a conventional automatic faucet.
Figure 12:
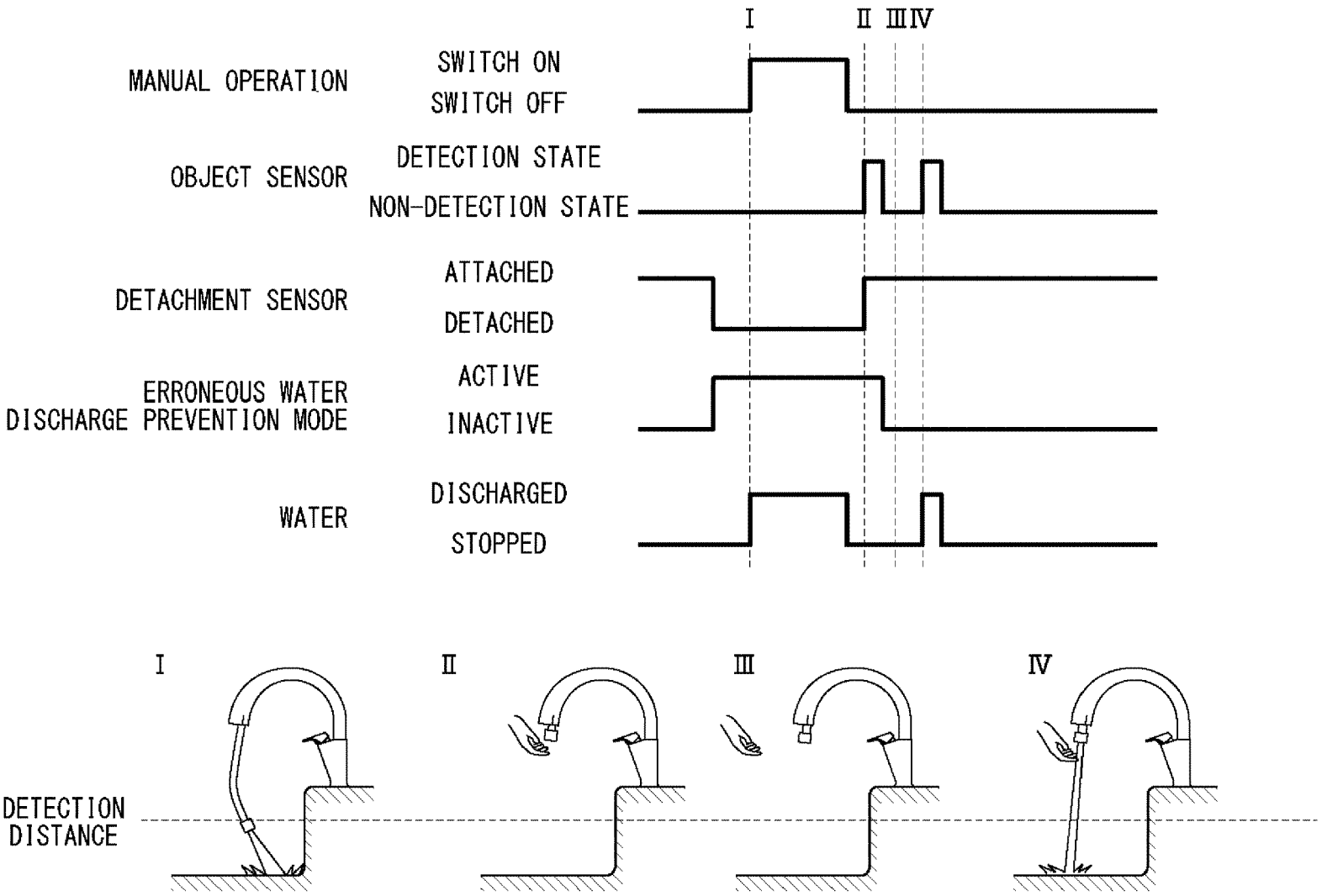
FIG. 12 is a diagram illustrating exemplary operations of a conventional automatic faucet.

FIGS. 11 and 12 are diagrams illustrating exemplary operations of conventional automatic faucets. FIG. 11 is a diagram illustrating an automatic faucet that prohibits automatic water discharge for a predetermined certain period of time after a water discharger 170 is attached to a retainer 172. At (I), a user pulls out the water discharger 170 and manually causes water discharge. At (II), water is stored in a bowl in a sink and a water surface enters within a detection distance. At (III), operation by the user ends and the user manually stops water and attaches the water discharger 170. When the certain period of time elapses after the water discharger 170 is attached, the erroneous water discharge prevention mode is canceled. Therefore, the erroneous water discharge prevention mode is canceled at (IV) and the water surface in the bowl is detected. Erroneous water discharge thus occurs.

FIG. 12 is a diagram illustrating an automatic faucet that prohibits automatic water discharge from attachment of a water discharger 170 to a retainer 172 until no object is detected. At (I), a user pulls out the water discharger 170 and manually causes water discharge to start work. At (II), work of the user ends and the user manually stops water and attaches the water discharger 170. When the user moves a hand away from the water discharger 170 after attaching the water discharger 170, the object sensor 1 detects no object and thus the erroneous water discharge prevention mode is canceled. At (III) the user notices that the water discharger is almost detached and reaches a hand at (IV). Since the erroneous water discharge prevention mode is already canceled, erroneous water discharge occurs.

Figure 13:
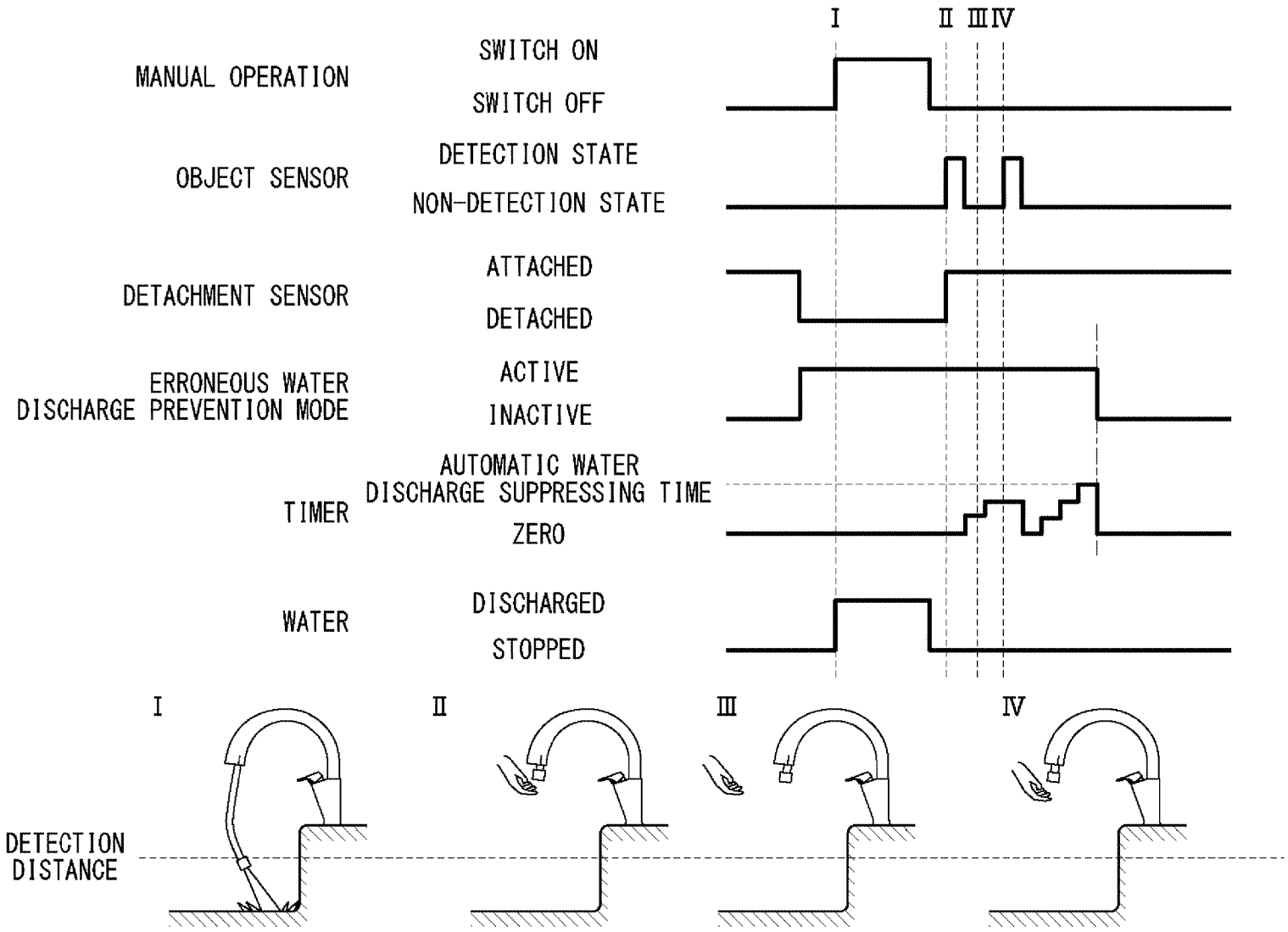
FIG. 13 is a diagram illustrating exemplary operations of the automatic faucet of the embodiment.

FIG. 13 is a diagram illustrating exemplary operations of the automatic faucet 16 of the embodiment. At (I), a user pulls out the water discharger 170 and manually causes water discharge. At (II), work of the user ends and the user manually stops water and attaches the water discharger 170. At (III) the user notices that the water discharger is almost detached and reaches a hand at (IV). Upon detection of the hand of the user, a timer that measures duration time of non-detection state of an object is halted. Therefore, the erroneous water discharge prevention mode is not canceled even after an initial automatic water discharge suppressing time elapses and thus erroneous water discharge does not occur. Then the duration time of the non-detection state of an object (preceding counting by the timer) is reset and measurement of duration time is performed again from a default value (e.g. zero). When the timer detects that the non-detection state of an object has continued for the automatic water discharge suppressing time, the erroneous water discharge prevention mode is canceled.

In this manner, according to the automatic faucet 16 of the embodiment, water discharge unintended by a user can be prevented even when an object is left within a detection distance or when a hand once moved away from the water discharger 170 is again placed close thereto after the user attaches the water discharger 170 to the retainer 172. Furthermore, since a duration period of a non-detection state of an object is reset when the object is detected while the duration period is being measured, erroneous water discharge can be prevented even when an object such as a water surface exists near an upper limit of the detection distance and detection and non-detection of the object is alternately repeated due to the moving water surface. The automatic faucet 16 is especially suitable as a faucet for a kitchen where washing dishes with water stored in a bowl or other activities are performed.

The present invention has been described above based on the embodiments. These embodiments are merely illustration. Therefore, it should be understood by a person skilled in the art that combinations of the components or processing processes of the examples may include various variations and that such a variation is also within the scope of the present invention.

A first variation will be described. Even before a non-detection state of an object by an object sensor 1 continues for automatic water discharge suppressing time after a water discharger 170 is attached to a retainer 172, that is during the erroneous water discharge prevention mode, the water supply controller 33 may cause water discharge triggered by detection of an object by the object sensor 1 when contents of detection of the object by the object sensor 1 satisfy a predetermined exception condition (S33 in FIG. 10). The exception condition may be related to the distance, time, or an image of the object detected by a line sensor 261. The exception condition is more difficult is be satisfied than the automatic water discharge conditions upon operation in a normal mode (hereinafter referred to as "normal operation") which is not the erroneous water discharge prevention mode. In other words, the exception condition is for limiting automatic water discharge more strictly. When the exception condition is satisfied, it is assumed that the user intends to cause water discharge. Therefore, restarting automatic water discharge even in the erroneous water discharge prevention mode allows for enhancing convenience for the user.

With reference to FIG. 8, an example where a condition related to the distance is set as an exception condition will be described. A range A in FIG. 8 is a proximity range of the object sensor 1 where it is assumed that a hand of a user approaches for attaching or detaching the water discharger 170. A range C is a proximity range of the maximum detection distance by the object sensor 1 where it is assumed that an object is left after work while the water discharger 170 is detached. A range B positioned between the range A and the range C is a range where it is assumed that a user places a hand or an object when intending to cause automatic water discharge. In normal operation, automatic water discharge is performed when an object is detected at any position in the ranges A, B, and C.

The object determiner 34 may transmit, to the water supply controller 33, target presence information including a distance to an object measured by the distance measurer 32. The water supply controller 33 initiates automatic water discharge triggered by detection of the object by the object sensor 1 even in the erroneous water discharge prevention mode when the distance to the detected object is within the range B. On the contrary, when the distance to the detected object is within the range A or C, automatic water discharge is suppressed like in the embodiment. According to this embodiment, a user can use automatic water discharge immediately after attaching the water discharger 170 while erroneous water discharge is prevented. Therefore, convenience for the user can be enhanced.

Values of the ranges A, B, and C may be set at an appropriate value (distance range) by knowledge or experience of a developer of the automatic faucet 16 or an experiment using the automatic faucet 16. Furthermore, a duration period of a non-detection state of an object may be reset when the object is detected in the range A, or C while setting of the duration period may be skipped assuming that the non-detection state of an object is continuing when an object is detected in the range B and the erroneous water discharge prevention mode may be immediately canceled. The distance from the object sensor 1 to the object which is employed as the condition here can be also referred to as a distance from the water discharger 170 installed near the object sensor 1 to the object or a distance from the automatic faucet 16 to the object.

As the exception condition, a condition related to an image of the object detected by the line sensor 261 may be set. The present inventors have found that, in the graph of the differential data D(x) with the horizontal axis representing the pixel number x and the vertical axis representing the pixel value (amount of light received) illustrated in FIG. 7, reflection light is prone to diffusion and an inclination of the graph is relatively moderate when a detection target is a hand or a finger of a person. The present inventors have also found that reflection light is unlikely to be diffused and an inclination of the graph is relatively steep when a detection target is a mirror surface object such as a water surface, a dish made of metal, a ceramic dish, or the like In other words, when a distance measurement target is a hand or a finger of a person, differential data D(x) of reflection light thereof forms a relatively moderate distribution of a mountain-like shape. When a distance measurement target is a mirror surface object, differential data D(x) of reflection light thereof forms a relatively steep distribution of a mountain-like shape.

The object determiner 34 transmits, to the water supply controller 33, information representing a distribution pattern of pixel values of the differential data D(x), for example information representing an inclination of a graph of the differential data D(x). In the erroneous water discharge prevention mode, the water supply controller 33 determines whether a distribution pattern of pixel values in the differential data D(x) matches a distribution pattern representing a hand or a finger of a person which is a predetermined condition of an object image. For example, the water supply controller 33 may determine whether an inclination of a graph of the differential data D(x) based on a distribution pattern of pixel values in the differential data D(x) is less than or equal to an inclination predetermined as the condition of an object image.

When the distribution pattern of pixel values in the differential data D(x) satisfies the object image condition, the water supply controller 33 restarts automatic water discharge triggered by detection of an object by the object sensor 1. The erroneous water discharge prevention mode maybe further canceled at this time. According to this embodiment, automatic water discharge can be restarted when a hand or a finger of a person is detected while automatic water discharge is suppressed upon detection of a mirror surface object in the erroneous water discharge prevention mode. Therefore, restarting of automatic water discharge corresponding to intention of a user is likely to be implemented.

Note that automatic water discharge maybe of course restarted and the erroneous water discharge prevention mode may be canceled when detection contents by the object sensor 1 satisfy a desired combination of exception conditions of a plurality of types. For example, when satisfying both of the above distance condition and the object image condition is assumed as a condition for immediate cancellation of the erroneous water discharge prevention mode, the erroneous water discharge prevention mode is canceled when a hand of a user is placed in the range B and the erroneous water discharge prevention mode is not canceled when a dish made of metal, a ceramic dish, or the like is left in the range B. In this manner, an automatic faucet with preferable usability that restarts automatic water discharge according to intention of a user while effectively preventing erroneous water discharge can be implemented.

A second variation will be described. Suppression time of automatic water discharge may be adjustable by a user. For example, a controller 3 may further include an updater that stores, in a storage device such as a memory, a value of time input by a user via a predetermined interface as new suppression time of automatic water discharge when predetermined user operation is detected such as placing a hand to a manual operation sensor 163 for a certain period of time or more. This allows a user to adjust preferable suppression time of automatic water discharge according to use state of an automatic faucet 16 that may be different for every user.

It should be understood by a person skilled in the art that a function to be implemented by each component described in the claims is implemented solely by one of the components described in the embodiment or the variation or by coordination thereof. For example, the first detector described in the claims may be implemented by a combination of the detachment sensor 174 and the detachment determiner 36. The second detector described in the claims may be implemented by a combination of the object sensor 1, the imaging controller 31, the distance measurer 32, and the object determiner 34.

DESCRIPTION OF THE REFERENCE NUMERALS

1 object sensor, 16 automatic faucet, 33 water supply controller, 168 water discharge port, 170 water discharger, 172 retainer, and 174 detachment sensor.

INDUSTRIAL APPLICABILITY

The present invention is applicable to an automatic faucet and a kitchen including the automatic faucet.

What is claimed is:

1. An automatic faucet comprising:

a water discharger having a water discharge port;

a retainer that detachably retains the water discharger;

a first detector that detects detachment and reattachment of the water discharger from and into the retainer;

a second detector that detects presence of an object; and a water supply controller, wherein in the event of the first detector detecting the water discharger being fitted into the retainer, the water supply controller is configured to cause the faucet to discharge water triggered by the detection of the object by the second detector, and in the event of the first detector detecting the water discharger being detached from the retainer, the water supply controller is configured to suppress the water discharge from the faucet if the second detector detects the object, if reattachment of the water discharger into the retainer is detected by the first detector after detachment of the water discharger from the retainer is detected, the water supply controller is configured to suppress the water discharge triggered by the detection of the object by the second detector until an object non-detection state, in which no object is detected by the second detector, continues for a predetermined time period from reattachment of the water discharger into the retainer.

2. The automatic faucet according to claim 1, wherein the water supply controller measures duration time of the object non-detection state, and resets the duration time if the second detector detects an object before the duration time reaches the predetermined time.

3. A kitchen comprising the automatic faucet according to claim 1.

4. The automatic faucet according to claim 1, wherein if a predetermined exception condition is satisfied even before the object non-detection state has continued for the predetermined time, on object detection by the second detector as a trigger, the water supply controller causes the faucet to discharge water.

5. The automatic faucet according to claim 4, wherein the predetermined exception condition includes that a distance to an object detected by the second detector coincides with a distance determined in advance.

* * * * *